US005877133A

United States Patent [19]

Good

[11] Patent Number: 5,877,133

[45] Date of Patent: Mar. 2, 1999

[54] ESTER-BASED CLEANING COMPOSITIONS

[75] Inventor: Charles J. Good, Ramsey, N.J.

[73] Assignee: Penetone Corporation, Tenafly, N.J.

[21] Appl. No.: 963,153

[22] Filed: Nov. 3, 1997

Related U.S. Application Data

[63] Continuation of Ser. No. 538,994, Oct. 5, 1995, abandoned.

[51] Int. Cl.[6] ..... C11D 1/827; C11D 3/20

[52] U.S. Cl. ..... 510/175; 510/178; 510/437; 510/505; 510/365

[58] Field of Search ..... 510/175, 178, 510/437, 505, 365

[56] References Cited

U.S. PATENT DOCUMENTS

| | | | |
|---|---|---|---|
| 4,168,989 | 9/1979 | Edelman et al. | 134/28 |
| 4,176,080 | 11/1979 | Wise et al. | 252/162 |
| 4,180,472 | 12/1979 | Mitchell et al. | 252/162 |
| 4,208,301 | 6/1980 | Gammon | 252/321 |
| 4,295,845 | 10/1981 | Sepulveda et al. | 8/139.1 |
| 4,792,416 | 12/1988 | Shimizu | 252/369 |
| 4,851,140 | 7/1989 | Nuesslein et al. | 252/8.8 |
| 4,877,556 | 10/1989 | Wilsberg et al. | 252/544 |
| 4,954,292 | 9/1990 | Hull et al. | 252/542 |
| 5,031,648 | 7/1991 | Lutener et al. | 134/32 |
| 5,035,826 | 7/1991 | Durbut et al. | 252/121 |
| 5,093,112 | 3/1992 | Birtwistle et al. | 424/70 |
| 5,106,525 | 4/1992 | Sullivan | 252/162 |
| 5,120,371 | 6/1992 | Bolden et al. | 134/40 |
| 5,143,639 | 9/1992 | Krawack | 252/162 |
| 5,194,173 | 3/1993 | Folkard et al. | 252/170 |
| 5,230,821 | 7/1993 | Larson et al. | 252/170 |
| 5,254,290 | 10/1993 | Blandiaux et al. | 252/545 |
| 5,264,045 | 11/1993 | Zofchak | 134/40 |
| 5,281,354 | 1/1994 | Faber | 252/154 |
| 5,308,526 | 5/1994 | Dias et al. | 252/125 |
| 5,312,559 | 5/1994 | Kacher et al. | 252/125 |
| 5,340,493 | 8/1994 | Principato | 252/462 |
| 5,360,489 | 11/1994 | Gaul et al. | 134/42 |
| 5,380,453 | 1/1995 | Krawack | 252/162 |
| 5,391,325 | 2/1995 | Swenson et al. | 252/547 |
| 5,494,611 | 2/1996 | Howe | 252/548 |
| 5,523,013 | 6/1996 | Durbut et al. | 252/12.1 |
| 5,597,792 | 1/1997 | Klier et al. | 510/417 |

FOREIGN PATENT DOCUMENTS

| | | |
|---|---|---|
| 4029700 | 10/1992 | Japan . |
| 6093295 | 4/1994 | Japan . |

OTHER PUBLICATIONS

American Chemical Society, reg. nos. 61788–59–8, 58969–05–4, 55272–73–6, 29387–86–8, 9016–45–9, 124–10–7, 112–61–8, 112–34–5, 111–82–0, and 110–42–9, Apr. 1997.

*Primary Examiner*—Paul Lieberman
*Assistant Examiner*—Gregory E. Webb
*Attorney, Agent, or Firm*—Darby & Darby

[57] ABSTRACT

Compositions are provided for removing grease or for cleaning substrates. The compositions include a lower ($C_1$–$C_4$) alkyl ester of a $C_{11}$–$C_{13}$ fatty acid, a non-cationic surfactant, and optionally, a coupling agent. Methods for removing grease or for cleaning are also provided.

16 Claims, No Drawings

ESTER-BASED CLEANING COMPOSITIONS

This is a continuation of application Ser. No. 08/538,994, filed Oct. 5, 1995, now abandoned.

FIELD OF THE INVENTION

This invention relates to cleaning compositions which include a lower ($C_1$–$C_4$) alkyl ester of a $C_{11}$–$C_{13}$ fatty acid, a non-cationic surfactant, and optionally, a coupling agent. These cleaning compositions may also include a relatively high volatile organic compound (VOC) solvent, but preferably they are free of volatile hydrocarbon solvents. Even without high VOC solvents, these compositions have excellent cleaning/degreasing properties.

BACKGROUND OF THE INVENTION

The Clean Air Act of 1990 imposed stringent restrictions on the amounts and types of materials that can be emitted into the atmosphere. One category of chemicals which was targeted for lower emissions is volatile organic compounds (VOCs). Although not specifically considered hazardous air pollutants, this group of materials is thought to contribute to the overall lowering of air quality.

Many high VOC content materials are excellent solvents and possess excellent cleaning properties. Such materials include low to intermediate flash point mineral spirits, lower alkyl aromatic hydrocarbons, terpene hydrocarbons, low molecular weight alcohol glycol ethers, ether acetates, and ketones. However, because of environmental regulation and related concerns, less hazardous alternatives have been sought.

For example, petroleum or vegetable oils have been mixed with high VOC solvents. However, the resultant products have proven unsuitable, due to the tendency of the petroleum or vegetable oil to impart high viscosity to the final product. High viscosity adversely affects the application and removal of the cleaning product. Furthermore, odor can be a problem, particularly with vegetable oils, because they can become rancid due to oxidation. Finally, these products are unsuitable for the removal of certain types of soil, such as some printing inks.

Prigge, U.S. Pat. No. 4,734,215, attempted to combine a major amount of a saturated hydrocarbon with a minor amount of at least one alkylated aromatic compound. The saturated hydrocarbon was an aliphatic and/or cycloaliphatic compound. Saturated hydrocarbons were incorporated because these were considered non-toxic.

Krawack, U.S. Pat. Nos. 5,143,639 and 5,380,453, discloses an emulsion of a $C_1$–$C_5$ alkyl ester of an aliphatic $C_8$–$C_{22}$ monocarboxylic acid as an ink remover.

Folkard et al., U.S. Pat. No. 5,194,173 removed inks and other oily contaminants from printing machines, printing plates, and offset blankets with a cleaning aid based on a $C_6$ or higher alkyl ester of a fatty acid, and preferably a $C_8$–$C_{22}$ fatty acid.

Woo et al., U.S. Pat. No. 5,232,632, disclose a detergent composition utilizing a $C_6$–$C_9$ alkyl aromatic, and particularly an alkyl benzene, as a hydrophobic solvent in combination with a mixture of non-ionic and zwitterionic detergent surfactants. The use of any other solvents is not disclosed.

Principato, U.S. Pat. No. 5,340,493, discloses cleaning compositions which include a tall oil fatty acid ester, organic solvents and optionally, a surfactant.

It has now been discovered that particular alkyl esters of fatty acids, when combined with non-cationic surfactants, and optionally a coupling agent, provide effective low VOC content, general purpose cleaning/degreasing compositions.

SUMMARY OF THE INVENTION

According to the present invention, there are provided compositions comprising (A) a lower ($C_1$–$C_4$) alkyl ester of a $C_{11}$–$C_{13}$ fatty acid; (B) a non-cationic surfactant; and (C) optionally, a coupling agent.

Additionally provided are methods for removing grease or for cleaning substrates. The substrate is contacted with the cleaning compositions above.

DETAILED DESCRIPTION OF THE INVENTION

The cleaner/degreaser compositions of the present invention have either low VOC content or are VOC (preferably high VOC) hydrocarbon free. High VOC solvents are those having a VOC content of greater than 50 percent. Preferably, the compositions are homogeneous solutions and, most preferably, are clear before the addition of optional colorant (s). Clarity is determined by silica turbidity, a clear solution having a turbidity of 100 NTU (standards available from Advanced Polymer Systems, Inc.) Lower ($C_1$–$C_4$) alkyl esters of $C_{11}$–$C_{13}$ fatty acids suitable (for use in the present invention) include, but are not limited, to the appropriate esters of lauric and cis-9-dodecanoic acids. Preferably, the ester is a methyl ester, and most preferably, the ester is the methyl ester of lauric acid. Mixtures of more than one lower ($C_1$–$C_4$) alkyl ester of a $C_{11}$–$C_{13}$ fatty acid may be used in the present invention.

Non-cationic surfactants include, but are not limited to, anionic surfactants, non-ionicsurfactants, amphoteric surfactants, zwitterionic surfactants, or any combination of any of the foregoing.

Anionic surfactants include, but are not limited to, sulfates; sulfonates; phosphates; phosphonates; carboxylate soaps, including, but not limited to, $C_6$ –$C_{24}$ fatty acid soaps such as, for example, potassium and triethanolamine neutralized fatty acids; and carboxylates. Suitable anionic surfactants also include, without limitation, water-soluble salts of alkyl benzene sulfonates; alkyl sulfates; alcohol sulfates; alkyl sulfonates; alcohol sulfonates; alkylaryl sulfonates; alkyl polyethoxy ether sulfates; paraffin sulfonates; α-olefin sulfonates; a-sulfocarboxylates and their esters; alkyl glyceryl ether sulfonates; fatty acid monoglyceride sulfates and sulfonates; alkyl phenyl phenoxy ether sulfates; 2-acryloxyalkane-1-sulfonates; and β-alkyloxyalkane sulfonates.

Additionally included anionic surfactants are water-soluble salts, particularly the alkaline metal, ammonium, and alkanolammonium salts of organic sulfuric reaction products having their molecular structure and alkyl or alkylaryl group containing from about 8 to about 22, especially from about 10 to about 20 carbon atoms and a sulfonic acid or sulfuric acid ester group (included in the term "alkyl" is the alkyl portion of acyl groups). Examples of this group of surfactants are the sodium potassium alkyl sulfates, especially those obtained by sulfating the higher alcohols ($C_8$–$C_{18}$) produced by reducing the glycerides of tallow or coconut oil and sodium or potassium alkylbenzene sulfonates, in which the alkyl group contains about 9 to about 15, especially about 11 to about 13 carbon atoms, in straight chain or branch chain configuration and those prepared from alkyl benzenes obtained by alkylation with straight chain chloroparaffins (using aluminum trichloride catalysts) or straight chain olefins (using hydrogen fluoride catalysts). Special mention is made of linear straight chain alkyl benzene sulfonates in which the average of the alkyl group is about 11.8 carbons ($C_{11.8}$LAS).

Special mention is also made of anionic detergent compounds including the sodium $C_{10}$–$C_{18}$ alkyl glyceryl ether sulfonates, especially those ethers of higher alcohols derived from tallow and coconut oil, sodium coconut oil fatty acid monoglyceride sulfonates and sulfates; and sodium or potassium salts of alkyl phenyl ethylene oxide ether sulfate containing about 1 to about 10 units of ethylene oxide per molecule and wherein the alkyl groups contain about 8 to about 12 carbon atoms.

Also included are the water soluble salts or esters of α-sulfonated fatty acids containing from about 6 to about 24 carbon atoms in the fatty acid group and from about 1 to about 10 carbon atoms in the ester group; water-soluble salts of 2-acyloxy-alkane-1-sulfonic acids containing from about 2 to about 9 carbon atoms in the acyl group and from about 9 to about 23 atoms in the alkane moiety; alkyl ether sulfates containing from about 10 to about 18, especially about 12 to 16 carbon atoms in the alkyl group and from about 1 to 12, especially 1 to 6, more especially 1 to 4 moles of ethylene oxide; water soluble salts of olefin sulfonates containing from about 12 to 24, preferably 14 to 16 carbon atoms especially those made by reaction with sulfur trioxide followed by neutralization under conditions such that any sulfones present are hydrolyzed to the corresponding hydroxy alkane sulfonate; water soluble salts of paraffin sulfonates containing from about 8 to 24, especially 14 to 18 carbon atoms and , β-alkyloxy alkane sulfonates containing from about 1 to about 3 carbon atoms in the alkyl group and from about 8 to 20 carbon atoms in the alkane moiety. Salts of alkaryl polyether sulfonates can also be utilized.

Suitable non-ionic surfactants include, but are not limited to, alkoxylated compounds produced by the condensation of alkylene oxide groups (hydrophilic in nature) with an organic hydrophobic compound (aliphatic, aromatic, or aryl aromatic). Non-limiting examples of suitable non-ionic surfactants also include the polyethylene oxide condensates of alkyl phenols, ie., condensation products of alkyl phenols having an alkyl group containing from 6 to 12 carbon atoms in either a straight chain or branched chain configuration, with ethylene oxide, being present in amounts equal to 5 to 25 moles of ethylene oxide per mole of alkyl phenol. The alkyl substituent in such compounds may be derived, for example, from polymerized propylene, diisobutylene, octene, and nonene. Other examples include dodecylphenol condensed with 12 moles of ethylene oxide per mole of phenol; dinonylphenol condensed with 15 moles of ethylene oxide per mole of phenol; nonylphenyl and di-iso-isooctylphenol condensed with 15 moles of ethylene oxide.

Further examples of suitable non-ionic surfactants are the condensation products of primary or secondary aliphatic alcohols having from 8 to 24 carbon atoms, in the either straight chain or branched chain configuration, with 1 to about 30 moles of alkylene oxide per mol of alcohol. Preferably, the aliphatic alcohol comprises between 9 and 15 carbon atoms and is ethoxylated with between 2 and 12, preferably between 3 and 9 moles of ethylene oxide per mole of aliphatic alcohol.

Other non-ionic compounds useful in the present invention can be prepared by condensing ethylene oxide with a hydrophobic base formed by the condensation of propylene oxide with either propylene glycol or ethylene diamine.

Typically, the hydrophilic-lipophilic balance (HLB) of the non-ionic surfactant should be less than about 12. Preferably, the HLB should be less than about 11, and most preferably, the HLB should be less than about 10.

Suitable amphoteric surfactants include, but are not limited to, water soluble derivatives of aliphatic secondary and tertiary amines in which the aliphatic moiety can be straight chain or branched and wherein one of the aliphatic substituents contains from about 8 to 18 carbon atoms and one of the aliphatic substituents contains an anionic water-soluble group, e.g. carboxy, sulfonate, sulfate, phosphate, or phosphonate.

Mixtures of any of the surfactants above are useful as well. Preferred mixtures are mixtures of anionic and non-ionic surfactants. Most preferred mixtures are mixtures of alkylbenzene sulfonates, alkyl sulfates, alcohol sulfates, alkyl sulfonates, alcohol sulfonates, alkyl polyethoxy ether sulfates, and/or carboxylate soaps, or any combination thereof with alcohol, alkylphenol condensation products of ethylene oxide, or any combination thereof.

Suitable coupling agents include, but are not limited to, low molecular weight alkanols such as methanol, ethanol, proponal, isopropanol, and the like; mono-or dialkyl glycol ethers derived from ethylene or propylene glycol and lower oligomers thereof, such as, for example, ethylene glycol methyl ether, ethylene glycol ethyl ether, ethylene glycol butyl ether, diethylene glycol methyl ether, diethylene glycol methyl ether, diethylene glycol butyl ether, propylene glycol propyl ether, propylene glycol t-butyl ether, dipropylene glycol n-butyl ether, and dipropylene glycol t-butyl ether; low molecular weight cyclic alcohols such as cyclohexanol; low molecular weight terpene alcohols such as iso-borneol, carveol, alpha-terpineol, menthol, nerol, geraniol, linalool, citronellol, hydroxy-citronellol, beta-terpineol, and the like, and the complex mix of terpene alcohols sold under the generic class of pine oils or terpene alcohols (e.g. Unipine®—trademark of Union Camp, Pine Oil 60, 80, etc. from SCM-Glidco); low molecular weight alkyl sulfates, alkyl sulfonates, or alkylaryl sulfonates such as sodium toluene sulfonate and sodium xylene sulfonate; low molecular weight salts of dicarboxylic acids such as Diacid™ 1550; glycols and oligomers thereof such as ethylene glycol, diethylene glycol, triethylene glycol, and the like, and propylene glycol, dipropylene glycol, tripropylene glycol, and the like; and combinations of any of the foregoing.

Preferred coupling agents include, but are not limited to, ethylene glycol monobutyl ether, diethylene glycol monobutyl ether, propylene glycol n-butyl ether, propylene glycol t-butyl ether, dipropylene glycol n-butyl ether, dipropylene glycol t-butyl ether, dipropylene glycol, pine oil, salts of Diacid 1550, and combinations of any of the foregoing.

Hydrocarbon solvents may be added, but preferably are not. These include for example, interrupted or uninterrupted hydrocarbons such as alpha-olefins, terpenes, lower ($C_1$–$C_4$) alkyl esters of low molecular weight ($C_2$–$C_9$) acids, and $C_8$–$C_{13}$ aromatics. Most preferred terpenes include, but are not limited to, d-limonene. Most preferred esters of low molecular weight ($C_2$–$C_8$) acids include, but are not limited to, lower ($C_1$–$C_4$) alkyl or di-lower alkyl ($C_2$–$C_8$) esters of fatty acids or diacids, and particularly dibasic esters such as the dimethyl esters of $C_2$–$C_8$ diacids such as the dimethyl esters of glutaric, adipic, and succinic acids such as those sold under the trade name DBE by DuPont-Wilmington, Del. Most preferred $C_8$–$C_{13}$ aromatics include, but are not limited to, benzene or naphthalene derivatives which have $C_1$–$C_7$ or $C_1$–$C_3$ constituents respectively either singly or multiply substituted. These hydrocarbons can be substituted with other functional groups such as hydroxy or amine groups and can be interrupted such as with one or more oxygen atom, nitrogen atom, sulfur atom, or any combination thereof.

Typically, mixtures of more than one high VOC unsaturated, substituted or unsubstituted, interrupted or uninterrupted hydrocarbons as described above will be used. An example of a mixture of $C_8$–$C_{13}$ aromatic hydrocarbon solvents is Aromatic 150 (Exxon Chemicals-Houston, Tex.). This solvent is a blend of high VOC $C_8$–$C_{13}$ aromatic hydrocarbons, which are primarily isomers of benzene substituted with single or multiple $C_1$–$C_5$ alkyl groups.

These high VOC unsaturated hydrocarbons may also be combined with other high VOC hydrocarbons such as aliphatics, cyclo-aliphatics, or saturated naphthalene-based (naphthalenic) hydrocarbons.

The compositions of the present invention typically have a pH ranging from about 2 to about 12, preferably from about 4 to about 10 and, most preferably from about 8 to about 10.

Typically, the weight ratio of (a) lower alkyl fatty acid ester to (b) surfactant and any optional coupling agent, ranges from about 2:1 to about 1:2. Preferably, the ratio ranges from about 1.5:1 to about 1:1.5, and most preferably, the ratio ranges from about 1.25:1 to about 1:1.25.

Water can also be used to dilute the composition to suitable strength such as, for example, in applications such as parts washing dip tanks, spray cabinets, in line spray washers, high pressure spray washing, etc. The determination of a suitable dilution would be within the ordinary skill of those in the art.

The cleaning compositions of the present invention are prepared by conventional methods known to those skilled in the art such as mixing or blending.

Any additional components well-known in the art to be included in cleaning compositions are within the scope of the present invention. Among the contemplated additives are antioxidants, corrosion inhibitors, preservatives, thickening agents, colorants, perfumes, buffers, or any combination of any of the foregoing.

Suitable anti-corrosion agents are those agents that inhibit the corrosion of metal. These agents include, but are not limited to, amines, including amine soaps, glycol amines, and alkanol amines, and particularly low molecular weight alkanol amines such as, for example, mono-, di-, and triethanolamine. Also suitable are barium sulfonate oils, sodium 2-mercaptobenzothiazole, tolyltrizole, and disodium 2,5-dimercapto-1,3,4-diazole. When an amine is used, the pKa of the amine should be about 9 or less, preferably about 8.5 or less, and most preferably about 8 or less.

These compositions of the present invention are useful in cleaning and/or degreasing. A cleaning and/or degreasing effective amount of the composition is contacted with a substrate and particularly hard surfaces. Examples of suitable substrates include, but are not limited to, metal, such as, for example, engine bodies, truck exteriors, machined metal parts, pipes of various composition (steel, stainless steel, aluminum, brass, bronze, etc.); concrete; plastic; glass; ceramic; brick; wood; painted surfaces; and the like. Methods of applying the cleaner include, but are not limited to, automatic or manual spraying, soaking, brush, rag, mop, and the like.

DESCRIPTION OF THE PREFERRED EMBODIMENTS

The following examples illustrate the invention without limitation. All parts are given by weight unless otherwise indicated.

EXAMPLE 1 AND COMPARATIVE EXAMPLES 1A–1D

Cleaning compositions were prepared according to the formulations of Table 1 below.

Cleaning efficiencies of the formulations were determined according to Mil-C-87937B test method 4.6.21. Results are illustrated in Table 2 below.

TABLE 1

CLEANING FORMULATIONS

| EXAMPLE | 1 | 1A | 1B | 1C | 1D |
|---|---|---|---|---|---|
| Composition: | | | | | |
| Ester | | | | | |
| Methyl ester of $C_{12}$ fatty acid[A] | 26.5 | | | | |
| Methyl ester of $C_{10}$ fatty acid[B] | | 26.5 | | | |
| Methyl ester of $C_{14}$ fatty acid[C] | | | 26.5 | | |
| Methyl ester of $C_{18}$ fatty acid[D] | | | | 26.5 | |
| Methyl ester of $C_6$–$C_{18}$ fatty acid (mixture)[E] | | | | | 26.5 |
| Surfactant: | | | | | |
| Non-ionic surfactant[F] | 10 | 10 | 10 | 10 | 10 |
| Coupler: | | | | | |
| Propylene glycol n-butyl ether[G] | 5.9 | 5.9 | 5.9 | 5.9 | 5.9 |
| Butyl carbitol[H] | 12.6 | 12.6 | 12.6 | 12.6 | 12.6 |
| Other Additions: | | | | | |
| Corrosion Inhibitors[I] | 0.78 | 0.78 | 0.78 | 0.78 | 0.78 |
| Antioxidant (butylated hydroxy toluate) | 0.1 | 0.1 | 0.1 | 0.1 | 0.1 |
| Tall 0.1, 25% Resin | 10 | 10 | 10 | 10 | 10 |
| Triethanolamine | 0.5 | 0.5 | 0.5 | 0.5 | 0.5 |
| Potassium hydroxide (45%) | 4.2 | 4.2 | 4.2 | 4.2 | 4.2 |
| Sodium bicarbonate | 1.5 | 1.5 | 1.5 | 1.5 | 1.5 |
| Water | 27.92 | 27.92 | 27.92 | 27.92 | 27.92 |

[A]CE-1295 - Proctor & Gamble, Cincinnati, OH
[B]CE-1095 - Proctor & Gamble, Cincinnati, OH
[C]CE-1495 - Proctor & Gamble, Cincinnati, OH
[D]CE-1895 - Proctor & Gamble, Cincinnati, OH
[E]CE-618 - Proctor & Gamble, Cincinnati, OH
[F]Surfonic N-60 - Texaco, White Plains, NY
[G]Arco - Newton Square, PA
[H]Union Carbide - Danbury, CT
[I]0.28 parts Cobratec 298 - P.M.C. Specialties
0.5 parts Hostacor 2098 - Hoescht

COMPARATIVE EXAMPLE 1E 30 parts of d-limonene, 5 parts of diethanolamine, 5 parts of surfactant (Triton x -100-Union Carbide - Danbury, Conn.) and 60 parts of water were mixed to yield a hydrocarbon based cleaning composition.

Cleaning efficiency of the formulation was determined according to Mil-C-87937B test method 4.6.21. Results are illustrated in Table 2 below.

TABLE 2

CLEANING EFFICIENCIES

| Example | Cleaning Efficiency (%) | Flash Point (TCC) (°C.) |
|---|---|---|
| 1 | 100.2 | >200 |
| 1A | 99 | — |
| 1B | 96.9 | — |
| 1C | 96.4 | — |
| 1D | 68 | — |
| 1E | 99.8 | 125 |

Table 2 illustrates that cleaning compositions that include a lower ($C_1$–$C_4$) alkyl ester of a $C_{11}$–$C_{13}$ fatty acid have superior cleaning efficiency. Comparative Examples 1A–1D demonstrate that cleaning efficiency falls off as the fatty acid carbon chain length is increased or decreased from the $C_{11}$–$C_{13}$ range. Additionally, comparative Example 1B demonstrates that mixtures having average chain lengths of about $C_{11}$–$C_{12}$ give poorer performance than relatively high purity single chain length materials.

Table 2 also illustrates that compositions according to the present invention (Example 1) have a higher flash point then hydrocarbon based compositions (Comparative Example 1E).

What is claimed is:

1. A composition consisting essentially of (A) a $C_1$ alkyl ester of a $C_{11}$–$C_{13}$ fatty acid;

(B) a nonionic surfactant; and (C) a coupling agent selected from the group consisting of ethylene glycol ethers, propylene glycol ethers, monohydric alcohols, polyhydric alcohols, or any combination of any of the foregoing.

2. A composition as defined in claim 1, comprising a homogenous solution.

3. A composition as defined in claim 1, wherein said solution is clear.

4. A composition as defined in claim 1, wherein said composition is volatile hydrocarbon solvent free.

5. A composition as defined in claim 1, wherein said ester comprises a $C_1$ ester of a $C_{12}$ fatty acid.

6. A composition as defined in claim 1, wherein said non-ionic surfactant comprises a member selected from the group consisting of fatty alcohol ethoxylates, alkylphenol ethoxylates, fatty alkyl polyglycosides, or any combination of any of the foregoing.

7. A composition as defined in claim 1, wherein said monohydric alcohols or polyhydric alcohols are terpene alcohols.

8. A composition as defined in claim 1, wherein said coupling agent has a molecular weight greater than 100.

9. A composition as defined in claim 1, wherein the ratio of (1) ester to (2) surfactant and coupling agent ranges from about 2:1 to about 1:2.

10. A composition as defined by claim 9, wherein said ratio ranges from about 1.5:1 to about 1:1.5.

11. A composition as defined in claim 9, wherein said ratio ranges from about 1.25:1 to about 1:1.25.

12. A composition as defined in claim 1, further comprising water.

13. A composition as defined in claim 1, having a pH ranging from about 2 to about 12.

14. A composition as defined in claim 13, having a pH ranging from about 4 to about 10.

15. A composition as defined in claim 14, having a pH ranging from about 8 to about 10.

16. A composition as defined in claim 1, further comprising (D) an antioxidant, (E) a corrosion inhibitor, (F) a preservative, (G) a thickening agent, (H) a colorant, (I) a perfume, (J) a buffering agent, or (K) any combination of any of the foregoing.

* * * * *

UNITED STATES PATENT AND TRADEMARK OFFICE

CERTIFICATE OF CORRECTION

PATENT NO. : 5,877,133

DATED : March 2, 1999

INVENTOR(S) : Charles J. Good

It is certified that errors appear in the above-identified patent and that said Letters Patent is hereby corrected as shown below:

Col. 7 Claim 1, line 3, change "nonionic" to --non-cationic--.

Claim 6, line 2, change "non-ionic" to --non-cationic--.

Signed and Sealed this

Thirteenth Day of June, 2000

*Attest:*

Q. TODD DICKINSON

*Attesting Officer*

*Director of Patents and Trademarks*